US011608144B2

(12) United States Patent
Werner

(10) Patent No.: US 11,608,144 B2
(45) Date of Patent: Mar. 21, 2023

(54) MOTORIZED WATERCRAFT

(71) Applicant: RIDE AWAKE AB, Limhamn (SE)

(72) Inventor: Philip Werner, Malmö (SE)

(73) Assignee: Ride Awake AB, Limhamn (SE)

( * ) Notice: Subject to any disclaimer, the term of this patent is extended or adjusted under 35 U.S.C. 154(b) by 0 days.

(21) Appl. No.: 17/135,419

(22) Filed: Dec. 28, 2020

(65) Prior Publication Data

US 2021/0206456 A1 Jul. 8, 2021

(30) Foreign Application Priority Data

Jan. 3, 2020 (SE) ..... 2050003-9

(51) Int. Cl.

| | |
|---|---|
| ***B63B 32/10*** | (2020.01) |
| ***B63B 34/10*** | (2020.01) |
| ***B63B 32/60*** | (2020.01) |
| ***B63H 21/17*** | (2006.01) |
| ***B63B 1/04*** | (2006.01) |
| ***B63B 32/50*** | (2020.01) |

(52) U.S. Cl.

CPC ..... *B63B 32/10* (2020.02); *B63B 1/042* (2013.01); *B63B 32/50* (2020.02); *B63B 32/60* (2020.02); *B63B 34/10* (2020.02); *B63H 21/17* (2013.01)

(58) Field of Classification Search

CPC ..... B63B 1/042; B63B 1/20; B63B 2001/201; B63B 32/10; B63B 32/50; B63B 32/60; B63B 34/10; B63H 21/17

See application file for complete search history.

(56) References Cited

U.S. PATENT DOCUMENTS 2,434,700 A * 1/1948 Keckley ..... B63B 32/10 440/46
2,440,345 A * 4/1948 Baker ..... B63B 35/50 114/61.1
3,405,677 A 10/1968 Smith
3,406,653 A * 10/1968 Mela ..... F02B 61/045 114/55.51
3,536,025 A 10/1970 Tierney et al.

(Continued)

FOREIGN PATENT DOCUMENTS

CA 2425484 10/2003
CN 201012743 Y 1/2008

(Continued)

OTHER PUBLICATIONS

Vermillion, EM 005331774-0002 filed Jun. 29, 2018, in the EUIPO, in the name of Phiwer Sports AB.

(Continued)

*Primary Examiner* — Ajay Vasudeva
(74) *Attorney, Agent, or Firm* — Capitol City TechLaw

(57) ABSTRACT

A motorized watercraft may include an elongated hull extending along a longitudinal central axis (L) and a propulsion system. The propulsion system may include a drive module. The drive module may be mounted to the elongated hull. The drive module may include a motor and a propelling member. The motor may be in driving connection with the propelling member. A bottom surface of the elongated hull may be provided with a first channel and a second channel that respectively extend along the elongated hull on each side of the longitudinal central axis (L).

16 Claims, 12 Drawing Sheets

(56) References Cited

U.S. PATENT DOCUMENTS

| | | | | |
|---|---|---|---|---|
| 3,548,778 | A * | 12/1970 | Smagala-Romanoff | F02B 61/045 440/85 |
| 3,608,512 | A * | 9/1971 | Thompson | B63B 34/10 440/87 |
| D289,031 | S | 3/1987 | Monostory | |
| 4,894,034 | A * | 1/1990 | Brown, III | B63B 32/50 441/74 |
| 5,184,563 | A | 2/1993 | Hislop | |
| 5,306,188 | A | 4/1994 | Skedeleski et al. | |
| 5,582,529 | A * | 12/1996 | Montgomery | B63B 34/10 441/74 |
| 5,839,384 | A | 11/1998 | Burg | |
| D410,515 | S * | 6/1999 | Alexander | D21/769 |
| 6,192,817 | B1 | 2/2001 | Dec et al. | |
| D446,273 | S | 8/2001 | Natale | |
| 6,796,858 | B2 | 9/2004 | Dusablon et al. | |
| 7,074,098 | B1 | 7/2006 | Acosta, Jr. | |
| 7,930,985 | B2 | 4/2011 | Walworth et al. | |
| 8,342,114 | B2 * | 1/2013 | Goubault | B63B 1/08 114/56.1 |
| 8,398,446 | B2 | 3/2013 | Railey et al. | |
| 8,702,458 | B2 | 4/2014 | Preston | |
| 8,951,079 | B2 | 2/2015 | Railey et al. | |
| 9,359,044 | B2 | 6/2016 | Langelaan | |
| 9,387,908 | B1 | 7/2016 | Paulino | |
| 10,011,329 | B1 | 7/2018 | Cooper | |
| 10,035,570 | B1 | 7/2018 | Barron | |
| 10,118,677 | B2 | 11/2018 | Zapata | |
| 10,150,544 | B2 | 12/2018 | Schibli | |
| D847,927 | S | 5/2019 | Duff | |
| 10,518,842 | B1 | 12/2019 | Kyle et al. | |
| D882,010 | S | 4/2020 | Vermillion | |
| 10,647,392 | B2 | 5/2020 | Trewern | |
| 11,383,797 | B2 * | 7/2022 | Werner | B63H 11/08 |
| 2002/0077007 | A1 | 6/2002 | Dagenais et al. | |
| 2002/0162498 | A1 | 11/2002 | Robinson et al. | |
| 2006/0254495 | A1 | 11/2006 | Eckert | |
| 2007/0190840 | A1 | 8/2007 | Hanada et al. | |
| 2009/0165696 | A1 | 7/2009 | Burroughs | |
| 2009/0249991 | A1 | 10/2009 | McGeever et al. | |
| 2011/0201238 | A1 | 8/2011 | Rott et al. | |
| 2013/0059489 | A1 | 3/2013 | Vlock et al. | |
| 2013/0157526 | A1 | 6/2013 | Martin | |
| 2014/0287283 | A1 | 9/2014 | Kimpara et al. | |
| 2015/0104985 | A1 | 4/2015 | Langelaan | |
| 2016/0207591 | A1 | 7/2016 | Loui et al. | |
| 2016/0347428 | A1 | 12/2016 | Mahar | |
| 2017/0007934 | A1 | 1/2017 | Hohns et al. | |
| 2018/0072383 | A1 | 3/2018 | Montague et al. | |
| 2018/0170502 | A1 | 6/2018 | Terada | |
| 2021/0024178 | A1 | 1/2021 | Weisenburger | |
| 2021/0114695 | A1 | 4/2021 | Weisenburger et al. | |
| 2021/0276669 | A1 | 9/2021 | Lyon et al. | |
| 2021/0347441 | A1 | 11/2021 | Lyon et al. | |
| 2021/0371053 | A1 | 12/2021 | Werner | |

FOREIGN PATENT DOCUMENTS

| | | | | |
|---|---|---|---|---|
| CN | 102951256 | A | 3/2013 | |
| CN | 205738032 | U | 11/2016 | |
| CN | 110844006 | A | 2/2020 | |
| DE | 4430775 | A1 | 3/1996 | |
| DE | 102013218735 | A1 * | 3/2015 | B63B 35/7943 |
| DE | 202017103703 | U1 | 7/2017 | |
| DE | 202015009474 | U1 | 10/2017 | |
| EP | 1107903 | B1 | 6/2001 | |
| EP | 3552947 | A1 | 10/2019 | |
| EP | 3569487 | A1 | 11/2019 | |
| EP | 3611092 | A1 | 2/2020 | |
| FR | 3078680 | A1 | 9/2019 | |
| GB | 498214 | A * | 1/1939 | B63B 1/20 |
| GB | 1406161 | | 9/1975 | |
| JP | H06171583 | A | 6/1994 | |
| JP | 2002193185 | A | 7/2002 | |
| KR | 20120003196 | U | 5/2012 | |
| KR | 101767476 | B1 | 11/2017 | |
| KR | 1020190131811 | A | 11/2019 | |
| KR | 102103228 | B1 | 4/2020 | |
| WO | 1999057006 | | 11/1999 | |
| WO | 2014145601 | A2 | 9/2014 | |
| WO | 2015039970 | A1 | 3/2015 | |
| WO | 2016061274 | A1 | 4/2016 | |
| WO | 2016144852 | A1 | 9/2016 | |
| WO | 2016193382 | A1 | 12/2016 | |
| WO | 2017069322 | A1 | 4/2017 | |
| WO | 2019129687 | A1 | 7/2019 | |
| WO | 2019141799 | A1 | 7/2019 | |
| WO | 2019143276 | A1 | 7/2019 | |
| WO | 2020242146 | A1 | 12/2020 | |

OTHER PUBLICATIONS

Werner et al., EM 007473020-0001 filed Jan. 3, 2020, in the EUIPO, in the name of Ride Awake AB.

Werner et al., Design U.S. Appl. No. 29/740,288, filed Jul. 2, 2020, in the name of Ride Awake AB.

* cited by examiner

MOTORIZED WATERCRAFT

This application claims priority under 35 USC 119(a)-(d) from Swedish Application No. 2050003-9 filed on Jan. 3, 2020, the entire contents of which are incorporated herein by reference.

TECHNICAL FIELD

The present invention relates to watercrafts. In particular, the invention relates to a motorized watercraft with an elongated hull.

BACKGROUND

In the field of motor driven watercraft systems and in particular motor driven boards such as driven surfboards and standup paddle boards, the watercraft may come up to quite high speeds. The high speed increases the friction in the water and also makes the watercraft more difficult to maneuver.

In particular in the field of motor driven surfboards the maneuverability is essential in order to provide the user the possibility to control the direction of the surfboard. Hence there is a need to provide a watercraft which is easier to maneuver even in high speeds.

The friction in the water results in a higher power consumption due to energy losses. Hence, there is a need to provide a watercraft with a decreased friction in the water.

SUMMARY

An object of the present invention is to mitigate and/or address the above described drawbacks with conventional driven watercrafts.

These objects and further objects, which will appear from the following description, have now been achieved by the technique set forth in the appended independent claim; preferred embodiments being defined in the related dependent claims.

According to an aspect a motorized watercraft to address said drawbacks is provided. The watercraft comprises an elongated hull and a propulsion system. The elongated hull extends along a longitudinal central axis. The propulsion system comprises a drive module. The drive module is mounted to the elongated hull. The drive module further comprises a motor and a propelling member. The motor is in driving connection with said propelling member.

A bottom surface of the elongated hull is provided with a first channel and a second channel each extending along the elongated hull on each side of the longitudinal central axis.

The above embodiments are by not to be construed as limiting the invention, rather, embodiments and aspects may be combined to yield yet further embodiments.

Further advantages and aspects are described below and set forth in the appended claims.

BRIEF DESCRIPTION OF DRAWINGS

Embodiments of the invention will be described in further detail below in the shape of non-limiting examples and with reference to the accompanying drawings, in which.

DETAILED DESCRIPTION

The invention will now be explained with reference to the accompanying drawings.

Figure 1:
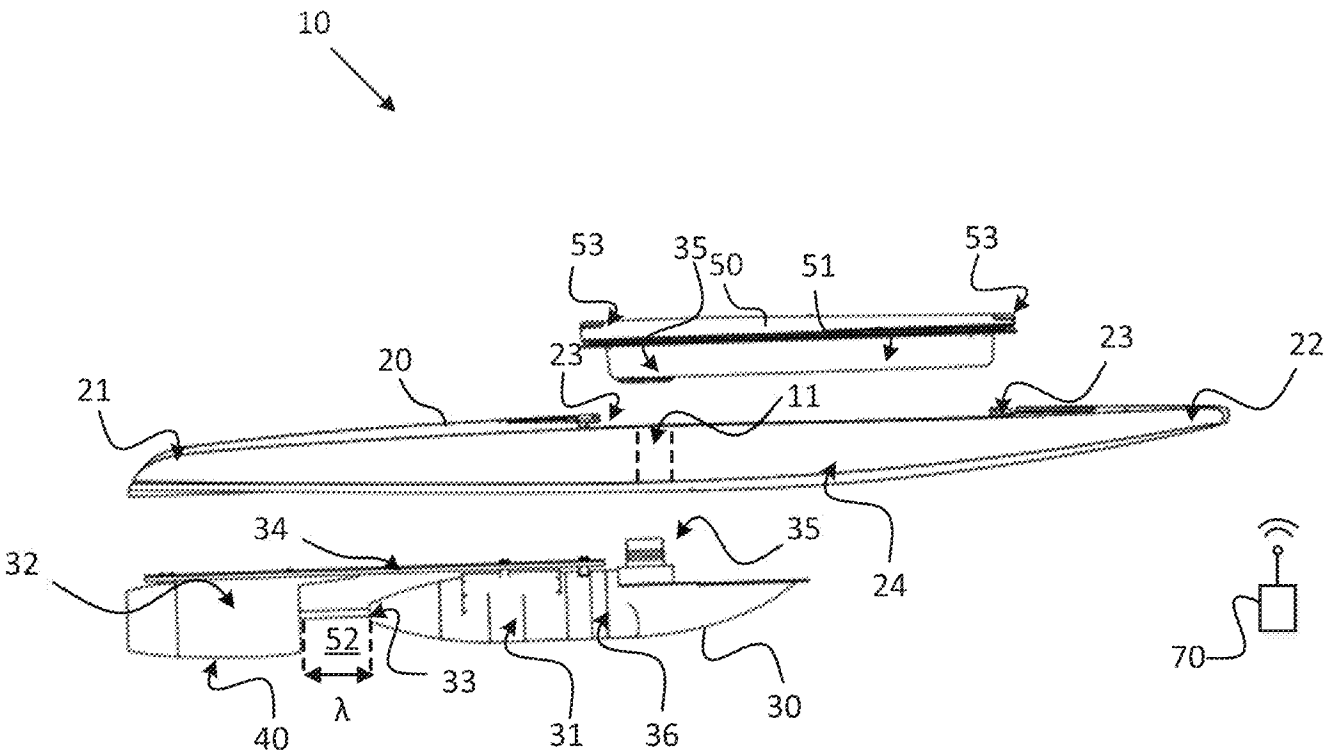
FIG. 1 shows a perspective side view of the watercraft according to an embodiment of the invention.

FIG. 1 shows a motorized watercraft 10 according to one embodiment of the invention. The watercraft 10 comprises an elongated hull 20. The elongated hull 20 may be in the form of a board. In one embodiment, the board is a surfboard. According to general aspects, the elongated hull may be in the form of an elongated hull module i.e. hull module 20 which may be fluid tight or waterproof. In this particular embodiment the board itself is also buoyant on its own merit and may comprise an empty shell-type hull. The elongated hull 20 has a front end 22 and a rear end 21 with the hull extending there between. The elongated hull may extend along a longitudinal central axis.

Hull module and elongated hull are interchangeable and thus interchangeably referenced throughout the description.

The watercraft 10 further comprises a propulsion system. The propulsion system is arranged to drive the watercraft 10. The propulsion system comprises a drive module 30. In one embodiment, the drive module 30 is arranged at a bottom surface of the elongated hull 20.

The propulsion system may further comprise a motor 31 and a propelling member 32. The motor 31 is in driving connection with the propelling member 32. Accordingly, the motor 31 is arranged to drive the propelling member 32 for propelling the watercraft 10. Further said motor 31 may be arranged to drive and/or power the drive module 30.

A motorized watercraft is herein referred to as a watercraft with a propulsion system, i.e. a motor driven watercraft.

In one embodiment, the motor 31 may be a combustion engine. The propulsion system may thus comprise a fuel tank and fuel supply lines for providing fuel to the motor 31. In one embodiment, which is depicted in FIG. 1, the propulsion system may comprise an electric power module 50 for powering and/or driving the drive module 30. The electric power module 50 may further be for powering and/or driving the motor 31.

Further referencing FIG. 1, the elongated hull 20 comprises means for receiving the electric power module 50 here in the form of a compartment 24, i.e. shelf like compartment 24, facilitating that an electric power module 50 is safely received and retained in the hull module 20 without risk of dislodging during operation of the watercraft 10. The electric power module 50 may comprise a shape corresponding to an external surface, such as the top-part of the hull module and thus become flush with edges of the hull module 20 and/or compartment 24 upon attachment to the hull module 20/compartment 24. Attachment means 23, 53 may be provided in the hull module 20 and/or on the electric power module 50 for detachable attachment of the electric power module 50 to the hull module 20. The attachment means 23, 53 may comprise releasable attachment means, such as a snap-in function.

The compartment 24 thus constitutes an external surface of the hull module 20 which may abut the electric power module 50. Preferably, the electric power module 50 is disposed flush with an upper surface of the hull module 20 when the electric power module 50 is received in the hull module 50.

A through-hole 11 in the form of a through hole extends through the hull module 20. Thus, the inner surface of through-hole 11 constitutes an external surface of hull module 20 such that no water is allowed to enter the hull module. According to aspects the hull module is independently waterproof or hermetically sealed, i.e. may be an independently waterproof hull module. Thus, the hull module 20 may be buoyant regardless its orientation in relation to water.

The through-hole 11 is adapted to receive a connector 35 of a drive module 30. The drive module 30 is adapted to be attached to a bottom external surface of the hull module 20. Thus, the entire drive module 30 is submerged in fluid, such as water, during operation of the watercraft 10. The drive module and/or the electric power module 50 may comprise power electronics for operating the watercraft. Such power electronics is known in the art and is not the subject of the current disclosure.

The drive module 30 comprises at least one motor 31 in driving connection with at least one propelling member 32, 139 via at least one drive shaft 33. The motor 31 may be comprised in a motor unit which also may comprise power electronics. The propelling member 32 may for example comprise one or more propellers. The drive module 30 may comprise casing or pods surrounding the propelling member.

The propelling member 32 and the motor 31 is separated by a spacing or gap having of length λ. The gap may be in the form of a void 52, i.e. a void space between the motor 31 and the impeller 139 or pod 40. The casing 40 and the motor 31 are respectively attached to a hull connection 34 which fixates the casing 40 and motor 31 in relation to each other. Thus, the casing 40 and the motor unit 31 are according to aspects not in direct contact with each other.

The drive module 30 may comprise an electronic speed controller 36 (ESC). In some embodiments, the ESC 36 is disposed in a portion of the drive module positioned vertically directly underneath the through-hole 11. The said portion of the drive module 30 may comprise the connector 35. This has the effect that the ESC will be passively cooled by means of water flowing from the through-hole 11 under the action of gravity. This is achieved since the through-hole 11 fluidly connects the top surface and bottom surface of the elongated hull 20 of the watercraft 10 and also during operation of the watercraft 10. Thus the drive module 30, and in particular the ESC may be water-cooled passively by means of gravity, e.g. during operation in water.

The through hole 11 further facilitates that, when the watercraft is in operation i.e. when a user makes speed over water, water is pushed upwards from beneath the elongated hull 20, through the trough-hole 11 to the compartment 24, and thereby cools the power module 50.

Further, the power module 50 and the compartment 24 are configured such that there is a slot between the power module 50 and the compartment 24 when the power module 50 is arranged in the compartment 24. Thereby, water from the ambient, e.g. splashing over the hull module 20, is allowed to fill up the compartment 24 via the slot and thus flow around, surround and at least partially submerge the power module 50, providing it with passive cooling.

The electric power module 50 and said drive module 30 connect electrically and mechanically via the through-hole 11. Thus, the electric power module 50 and the drive module 30 connect electrically and mechanically externally said hull module 20. The through hole 11 is disposed distant from the edges of the hull module 20, preferably substantially at a transversally centered position of the hull module 20. Thus, the through hole 11 comprises a circumferential rim and the hull module 20 extends continuously around/about the through-hole 11. The through hole 11 extends from a bottom surface of the hull module 20 to a top surface of the hull module 20. The through hole thereby fluidly connects an upper side to a lower side of the hull module 20 also when the watercraft is assembled.

Figure 6:
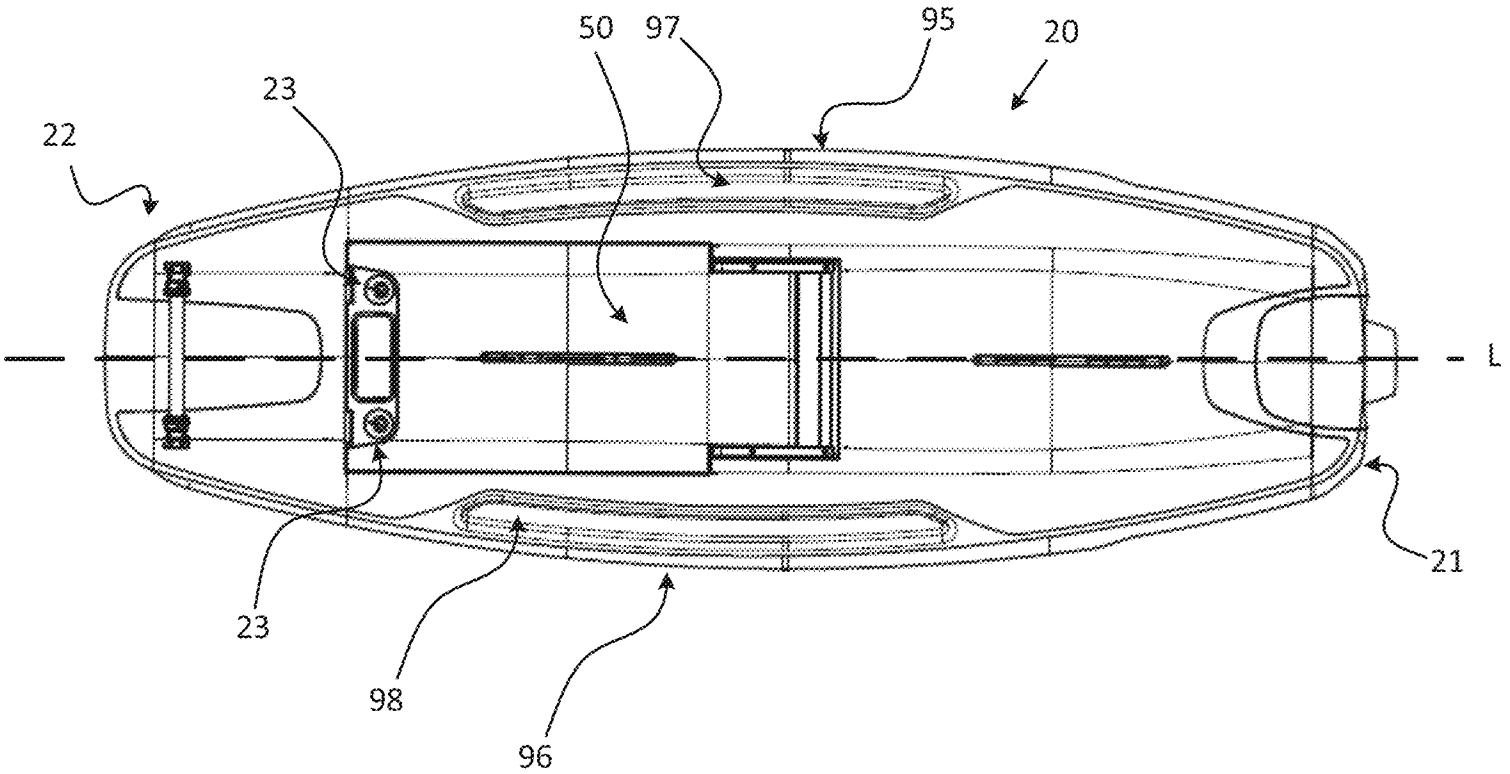
FIG. 6 shows an isometric top view of the watercraft according to an embodiment.

The electric power module 50 and/or the drive module 30 may at least partially extend into the through hole 11 as shown in FIGS. 1 and 6. This has the advantage that there are no electrical wires extending between the power module 50 and the drive module 30 as they connect solely by means of releasable connectors. This has the further advantage that the connector 35 extends above a bottom surface of the compartment 24.

The through hole 11 opens to and/or is in communication with the open compartment 24. Hence, the compartment 24 opens to the ambient and/or may constitute a depression in the elongated hull 20 which is open to ambient elements such as water during operation of the watercraft 10.

Each one of the electric power module 50 and/or the drive module 30 comprises respective electric connection means 35 and releasable mechanical connection means 35 for connecting to each other. Wherein the electric connection means 35 and/or the releasable mechanical connection means 35 is disposed externally to the hull module 20.

The electric connection means 35 and/or the releasable mechanical connection means 35 may be disposed in the compartment 24 as in the embodiment illustrated in FIG. 6. The mechanical connection 35 comprises a watertight connection. The mechanical connection means 35 may alternatively comprises a watertight connection disposed immediately adjacent the through hole 11. Alternatively, the electric power module 50 and/or the drive module 30 at least partially extends into said through-hole 11.

The mechanical connection 35 physically and sealingly connects, releasably locks and holds the electric power module 50 and the drive module 30 together. The mechanical connection 35 may comprise a releasable snap-in function.

The electric connection means 35 and releasable mechanical connection means 35 comprises a waterproof blind-mate connection 35 configured to connect the power module 50 to the drive module 30 simultaneously as the power module 50 is received in the compartment 24.

The through hole 11 provides a passage for cooling water through the hull module 20. The compartment 24 is configured to facilitate passive water cooling to the power module 50, in particular when the power module 50 is received in the compartment 24.

The compartment 24 is configured to allow water to flow therein when the power module 50 is received therein to thereby at least partially submerge the power module 50 in cooling water. The water that flow into said compartment 24 is allowed drain through the hull module 20 via the through hole 11. Thus, water accumulated in the compartment is drained under the action of gravity via the through hole 11 to provide passive cooling to the drive module 30. Hence, the through hole may be arranged to drain cooling water that flow into the compartment through the hull module.

The electronic speed controller 36 may be configured to control the operation of the drive module. Further, the electronic speed controller 36 may be further configured to control the operation of the motor 31.

In some embodiments, the remote control unit 70 is operatively connected to the electronic speed controller 36 for controlling the watercraft, e.g. the drive module. In some embodiments, the remote control unit 70 may be operatively connected to the electronic speed controller 36 via a communication unit. The communication unit may be disposed on the power module 50. The communication unit may be powered by means of said power module 50, e.g. the battery of the power module.

In some embodiments, the remote control unit 70 is operatively connected to the electronic speed controller 36 by means of electric wire or cable. In some embodiments, the remote control unit 70 may be connected to the electronic speed controller 36 via the communication unit by means of electric wire or cable. In some embodiments, the communication unit is coupled to the electronic speed controller 36 by means of contact pins.

In some embodiments, the remote control unit 70 is wirelessly connected to the electronic speed controller 36. In some embodiments, the remote control unit 70 is wirelessly connected to the electronic speed controller 36 via the communication device. The communication device may be wirelessly connected to the electronic speed controller 36.

In some embodiments, the watercraft or drive module may further comprise at least one amplifier, each of which being configured to strengthen the signals between the remote control unit 70 and the communication unit and/or the signals between the remote control unit 70 and the electronic speed controller 36 and/or the signals between the electronic speed controller 36 and the communication unit.

In some embodiments, at least one amplifier for strengthening the signals between the remote control unit 70 and the electronic speed controller 36 and/or the communication unit may be disposed on the external side of the hull module 20 or on the electric power module.

In some embodiments, at least one amplifier for strengthening the signals between electronic speed controller 36 and the remote control unit 70 and/or the communication device may be disposed on the electric power module 50 or the external side of the hull module 20.

In one embodiment, the modules 30, 50 and the elongated hull 20 are independent sub-assemblies and may thus comprise independent parts, whereby the elongated hull is an independent hull module. In particular, one or more of the modules 30 and 50 may be independent sub-assemblies arranged in a single housing, whereby the connector 35 is integrated or extends from the housing.

In one embodiment, the elongated hull 20 does not have any waterproof compartments for electronics, motors, gasoline or similar since all necessary electrical components are integrated in the propulsion system 60. Also, no electrical parts are integrated in the elongated hull 20. The power module 50 may comprise one or more of battery cells, a computer, battery management system, switches.

The motor 31 is typically installed in a waterproof container or casing of the drive module 30.

An external surface, preferably an upper surface of the elongated hull 20 comprises a shelf-like compartment 24 configured to receive and retain the electric power module 50.

An inner surface of the through-hole 11 constitutes an external surface of the hull module 20 such that no water is allowed to enter the hull module 20. The through-hole 11 penetrates the entire hull module 20, thus the through-hole 11 allows immediate access to the bottom surface of the hull module 20 from the upper side of the hull module 20 via the through hole 11.

The through-hole 11 is adapted to receive a connector 35 of the drive module 30. The through hole 11 preferably has a diameter sized to form a circumferential slot about the connector 35. A fluid passage between the inner circumference of the through hole and the connector 35.

Figure 2:
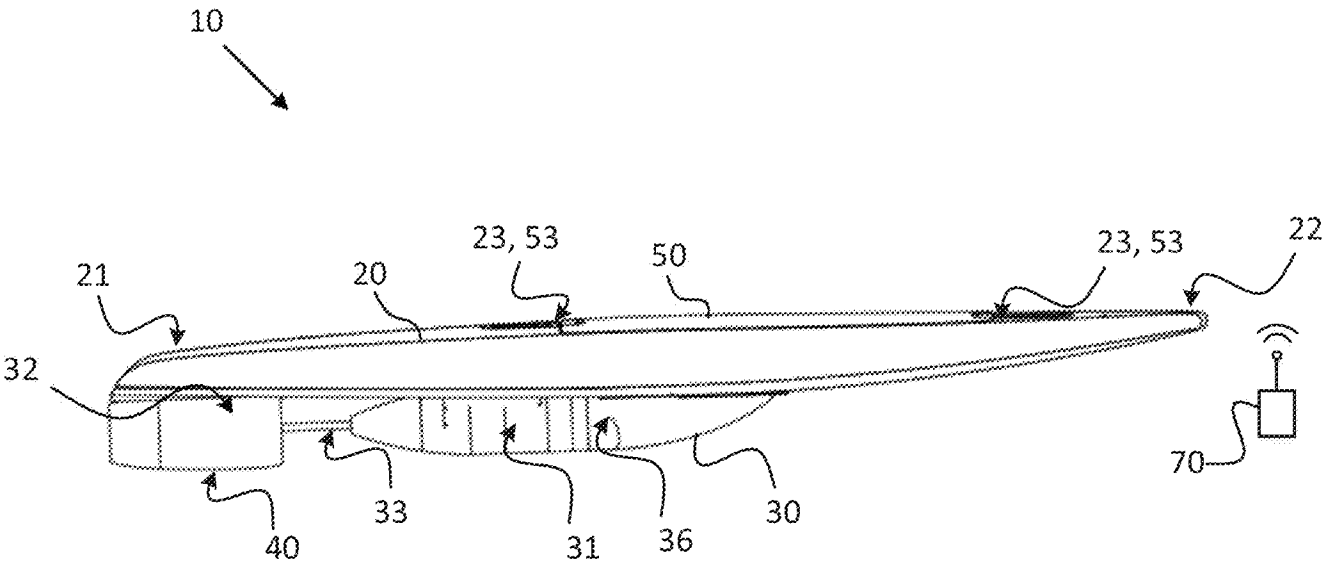
FIG. 2 shows an assembled view of the embodiment of FIG. 1.

FIG. 2 shows the watercraft 10 as described in conjunction with FIG. 1. In FIG. 2 the watercraft is assembled. The drive module 30 is attached to the bottom of the hull module 20 such that substantially the entire drive module 30 or the entire drive module 30 is submerged during operation, i.e. when the watercraft is launched into water.

During operation the water will provide passive water cooling to the drive module 30 and in particular to the motor 31. However, as the watercraft makes speed over water, the water flowing around the drive module 30 will provide efficient cooling.

It should be noted that due to the gap 52 of length $\lambda$, it is facilitated that the water enters the propelling member 32 at an advantageous angle with respect of the pitch of the propellers of the propelling member, i.e. the blades of the propelling member 32. The water may thus enter the casing 40 and/or the propelling member 32 in a direction substantially parallel the drive shaft 33, thereby increasing efficiency and performance of the propulsion system 60 i.e. by achieving greater speeds of the watercraft 10. The length of $\lambda$ may correspond to about 5 to 50% of the length of the drive module, preferably about 10 to 30%.

The watercraft 10 may be controlled by various means such as a speed control disposed on the electric power module 50 and/or on the drive module 30. The watercraft 10 may also be controlled via remote control, for example by means of a remote control unit 70.

The watercraft 10 may be suitable for personal transport or leisure. For example, a user may stand on the board or lay down on the board during operation. In a further example the user may lay down on the board and control the watercraft by operating the remote control unit 70.

The watercraft 10 may be a hydrofoiling watercraft, a motorized surfboard, a motorized wakeboard, a jet ski/water scooter, a motorized standup paddle board, over water drone or boat.

Figure 3:
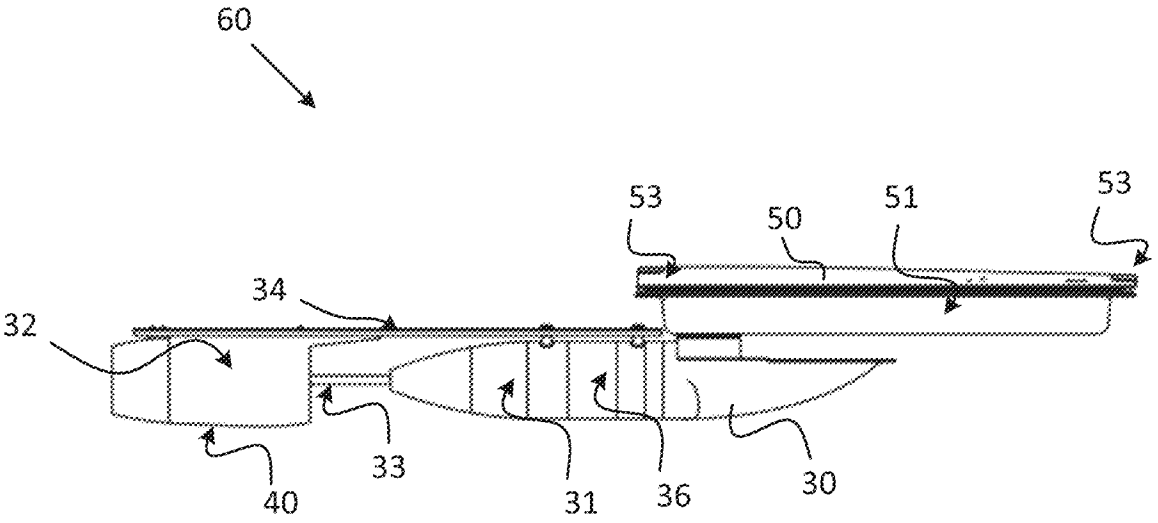
FIG. 3 shows a propulsion system according to one embodiment of the invention.

Referencing FIG. 3, the propulsion system 60 may be capable of operating independently the elongated hull 20, said elongated hull being an elongated hull module 20. Thus, the propulsion system 60 is, when assembled, fully waterproof. This feature has the advantage that it can operate externally the hull module 20 during operation of the watercraft 10 such that no electrical components, or no components essential for the basic function of the watercraft has to be integrated in the hull module. Thus, the elongated hull 20 may comprise only a dead shell. The drive module 30 is adapted to be attached to a bottom surface of the hull module, typically to a bottom external surface of the hull module 20. In particular, the motor 31 is arranged underneath the watercraft 10.

The hull module 20 is preferably independently waterproof and may also be independently buoyant. Further, the power module 50 and drive module 30 may each be individually waterproof.

The modules 20, 30, 50 may constitute individual parts. The modules constitute independent sub-assemblies in the form of modules which can be assembled to a fully functional watercraft.

The drive module 30 and the power module 50 may be fully connected by means of a single connector 35, for example a plug and socket arrangement.

The watercraft 10 may comprise one or more drive modules 30 connected to the hull module 20.

Substantially the entire drive module 30 is submerged in a surrounding fluid during operation of the watercraft 10. Thus, the drive module 30 is arranged to be submerged in surrounding fluid during operation of the watercraft 10. The drive module 30 comprises a water jet arrangement 137 comprising at least one impeller in driving connection with a motor 31 of the drive module 30 via a driving axle 33. The motor 31, the axle 33 and the water jet arrangement 137 are preferably arranged along a straight line, which may the longitudinal central axis. The motor 31 is disposed with an axial distance apart from the propelling member 32. In particular, the motor 31 and the water jet arrangement 137 are preferably entirely submerged during operation of the watercraft 10. However, connecting means, in the form of connector 35 may extend upwards from the drive module 30 and into the hull module 20, preferably through the hull module 20 via a through hole 11, as will be further explained herein. One possible meaning of the term "through hole" is that it extends through the whole entity, i.e. in this case the whole entity of the hull module 20.

The electric power module 50 and the drive module 30 are respectively configured to establish electric connection with each other and mechanical connection, preferably releasable mechanical connection with each other.

In one embodiment, the electric power module 50 is configured to be attached an external side of the elongated hull 20 and thus forms an external side of said watercraft 10, typically an upper side of the watercraft 10 and on which surface a user of the watercraft 10 can be positioned.

The electric power module 50 and the drive module 30 may be detachably attached on opposite sides of the elongated hull 20. This facilitates that the power module 50 can easily be switched out for another power module for example when the batteries are depleted, and so without pivoting or turning the elongated hull 20, for example when floating on water, The drive module 30 comprises at least one motor 31 in driving connection with a respective propelling member 32 by means of a drive shaft 33 and preferably the propelling member 32 is disposed at a rear end 21 of the watercraft 10. The propelling member 32 may be an impeller of a water jet arrangement 137, as will be further explained herein.

Figure 4:
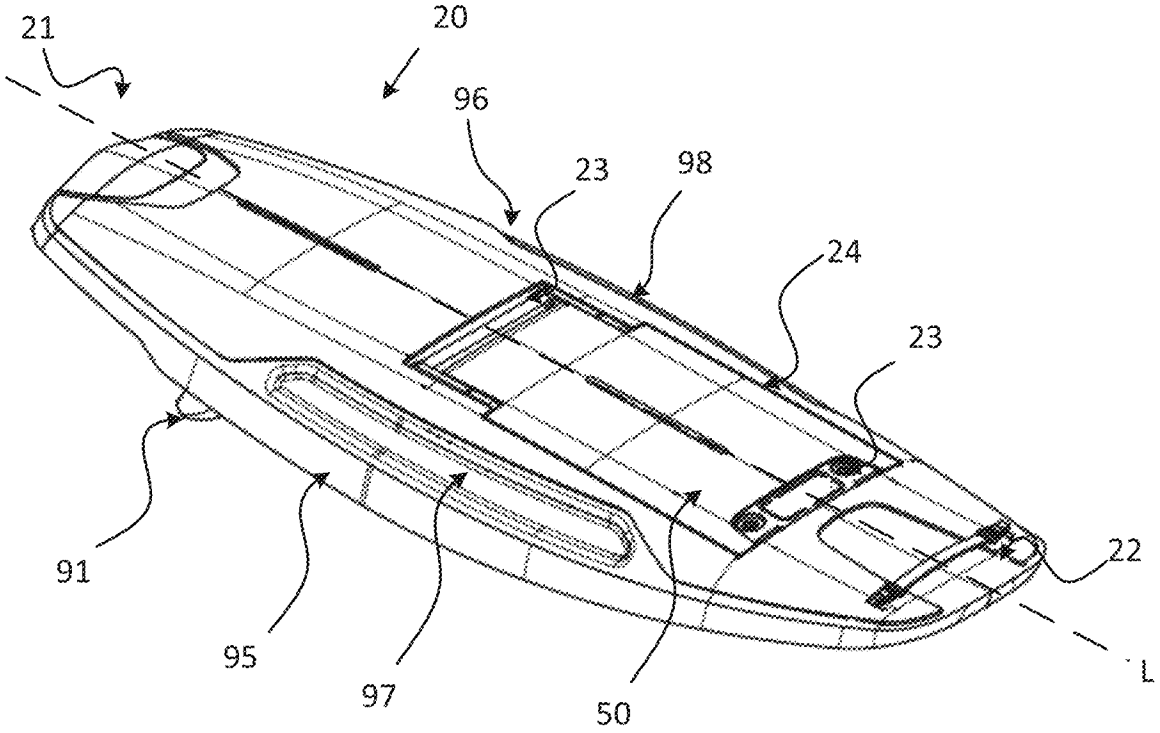
FIG. 4 shows an isometric view of the watercraft according to an embodiment of the invention.
Figure 5:
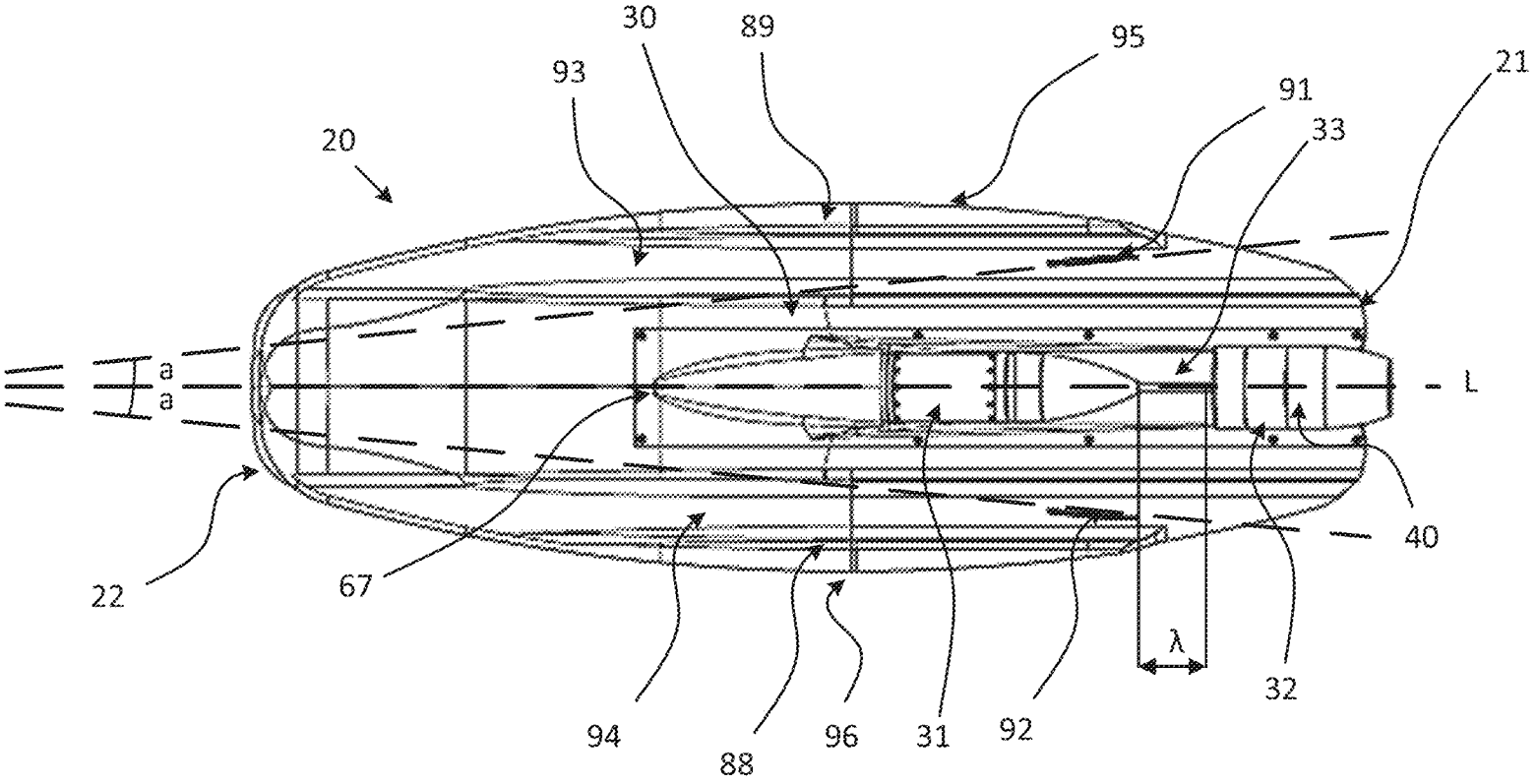
FIG. 5 shows an isometric bottom view of the watercraft according to an embodiment.

With reference to FIG. 4-6 different views of a motorized watercraft 10 according to an embodiment are depicted. The motorized watercraft 10 may incorporate any of the features described with reference to FIGS. 1 to 3. Accordingly, the motorized watercraft 10 comprises the elongated hull 20. The elongated hull extends along the longitudinal central axis L. The motorized watercraft 10 comprises the propulsion system 60. The propulsion system 60 comprises a drive module 30. The drive module 30 is mounted to the elongated hull 20. The drive module 30 comprises the motor 31 and the propelling member 32, 139.

As most clearly seen in FIG. 5, the bottom surface is provided with a first channel 93 and a second channel 94. The first channel 93 and the second channel 94 extends along the elongated hull 20. Said first channel 93 and second channel 94 extends along the elongated hull 20 on each side of the longitudinal central axis L.

The channels are associated with a number of advantages. Firstly, the channels allow air flow through them when the elongated hull is travelling straight forward. This decreases the friction in the water for the elongated hull which reduces the power consumption for the motorized watercraft. Accordingly, the first and second channel 93, 94 are arranged to provide air passage, i.e. to provide gap between the water surface and the bottom surface of the elongated hull 20, when the elongated hull 20 is travelling in a straightforward direction. Hence, the depth of the first and second channel is chosen so as to allow for said functionality.

Secondly, the channels improve the turning of the motorized surfboard greatly. When turning, the elongated hull will tilt about the longitudinal central axis L. This results in one of the channels tipping downwards into the water, whereby said channel becomes filled with water. The other channel will tip upwards into the air, whereby said channel becomes filled with air. The channels this provides a lifting force on one side and an increased grip in the water on the other. This greatly increases the efficiency in the turning of the watercraft. This is particularly advantageous where the motorized watercraft is a motorized surfboard which is maneuvered by the users changing their distribution of body weight on top of the elongated hull which is in the form of a board.

Thirdly, the channels increase the stiffness of the shell material of the elongated hull due to the non-uniform cross section which is formed. This creates a more durable and easier to control watercraft.

In one embodiment, the first channel 93 and the second channel 94 may extend along the entire length of the elongated hull 20. In one embodiment, said first channel 93 and second channel 94 may extend along a portion of the length of the elongated hull 20.

In one embodiment, the channels 93, 94 are formed as indentations in the bottom surface of the elongated hull 20. In one embodiment, the channels 93, 94 are formed by pairs of strips protruding from the bottom surface of the elongated hull 20.

Further, the propelling member 32, 139 may be arranged along the longitudinal central axis L. In one embodiment, the drive module 30 may be arranged along the longitudinal central axis L. This in conjunction with the channels allows for a watercraft which is easier to maneuver and turn.

In one embodiment, the drive module 30 may comprise a plurality of propelling members 32, 139, such propelling members may be distributed on both sides of the longitudinal central axis L.

To increase the above mentioned effects, the first channel 93 and the second channel 94 may be parallel with the longitudinal central axis L.

To further increase the maneuverability of the watercraft the elongated hull 20 may have a first outer side carve 95 and a second outer side carve 96. Said first outer side carve 95 and second outer side carve 96 extends longitudinally. Accordingly, the first outer side carve 95 may extend along the length of the elongated hull 20 on a first side of the longitudinal central axis L. The second outer side carve 96 may extend long the length of the elongated hull 20 on a second side of the longitudinal central axis L. The first side being opposite to the second side.

As is known to the skilled person a carve is an outer contour of the hull which is arranged to make contact with the water as the watercraft turns and thereby allow for maneuvering of the watercraft.

Thus, the first outer side carve 95 and the second outer side carve 96 may each form an outer surface portion of the elongated hull 20. Accordingly, the first outer side carve 95 may form a first outer surface portion of the watercraft (elongated hull) and the second outer side carve 96 may form a second outer surface portion of the watercraft (elongated hull), opposite to the first outer surface portion. The first outer surface portion and the second outer surface portion may extend longitudinally on each side of the elongated hull 20 and the longitudinal central axis L. The first and second outer surface portion may extend between a stern and a bow of the elongated hull, i.e. the front end 22 and the rear end 21 of the elongated hull.

The first outer side carve 95 and the second outer side carve 96 may each form a transition surface between the top surface and the bottom surface of the elongated hull. Thus, the top surface and the bottom surface of the elongated hull may be interconnected by means of said first outer side carve 95 and second outer side carve 96.

The first outer side carve 95 may be outwardly curved relative to the longitudinal central axis L. The second outer side carve 96 may be outwardly curved relative to the longitudinal central axis L. The second outer side carve 96 may be outwardly curved in an opposite direction relative the first outer side carve 95.

The first channel 93 may extend proximally to the first outer side carve 95. The second channel 94 may extend proximally to the second outer side carve 96. Thus the first channel 93 may extend longitudinally and proximally to a first outer longitudinal edge or surface portion of the elongated hull 20. The second channel 94 may extend longitudinally and proximally to a second longitudinal outer edge or surface portion of the elongated hull 20.

The first channel 93 and first outer side carve 95 may form a first lower protrusion 89 extending along the first outer side carve 95. The second channel 94 and second outer side carve 96 may form a second lower protrusion 88 along the second side carve 96. The first lower protrusion 89 and the second lower protrusion 88 may extend along the entire elongated hull 20 or only along a portion of the entire elongated hull 20.

The first lower protrusion 89 and the second lower protrusion 88 may thus have an outer edge at least partially forming the first outer side carve 95 and the second outer side carve 96, respectively. The first lower protrusion 89 and second lower protrusion 88 may further have an inner edge extending parallel to the longitudinal central axis L.

Further referencing FIG. 5, a first fin 91 is arranged inside the first channel 93 and a second fin 92 is arranged inside the second channel 94. The fins are arranged to direct the water flow inside the first 93 and second channel 94, respectively. The first fin 91 and second fin 92 may be arranged closer to the rear end 21 than the front end 22. Preferably, a rear end of the first and second fin may be aligned with a front end of the drive shaft 33. The fins increase the turning capability of the watercraft and allows for a more advantageous water flow inside the channels.

In one embodiment, the first fin 91 and the second fin 92 each are arranged in an outward angle a relative the longitudinal central axis L. The outward angle a may thus be considered an angle relative the longitudinal central axis L in a direction extending from the front end 22 to the rear end 21. The angular orientation of the fins allows for an increase in the turning capability of the watercraft. This is of particular importance in the case of the motorized watercraft being a motorized board, for example a surfboard. As the watercraft turns, one of the longitudinal sides will tip downwards, pushing the fin of that side deeper into the water. The angle of the fin will then force the water towards the channel greatly helping the turning motion and provide additional grip in the water for the turning.

Preferably, the outward angle a is between 0.5 and 15 degrees and even more preferably between 2 and 10 degrees and most preferably around 5 degrees.

It may further be envisaged that multiple fins may be utilized. Accordingly, there could be a plurality of fins arranged in each channel.

Turning to FIG. 6, an upper side, i.e. a top or upper surface, of the elongated hull 20 may be provided with a first recess 97 and a second recess 98. The upper side is opposite to the bottom surface of the watercraft 10. The first recess 97 extends along the first outer side carve 95. The second recess 98 extends along the second outer side carve 96.

The first and second recess forms indentations in the shell material of the watercraft. This increases the stiffness of the shell material of the elongated hull, which may be in plastic, carbon fiber, aramid fiber or glass fiber for example. The increased stiffness allows for a more durable and maneuverable watercraft.

In one embodiment, the first recess 97 and the second recess 98 may have a curved shape. The curved shape of the first recess 97 may correspond to the curvature of the first outer side carve 95 and the curved shape of the second recess 98 may correspond to the curvature of the second outer side carve 96.

Figure 7:
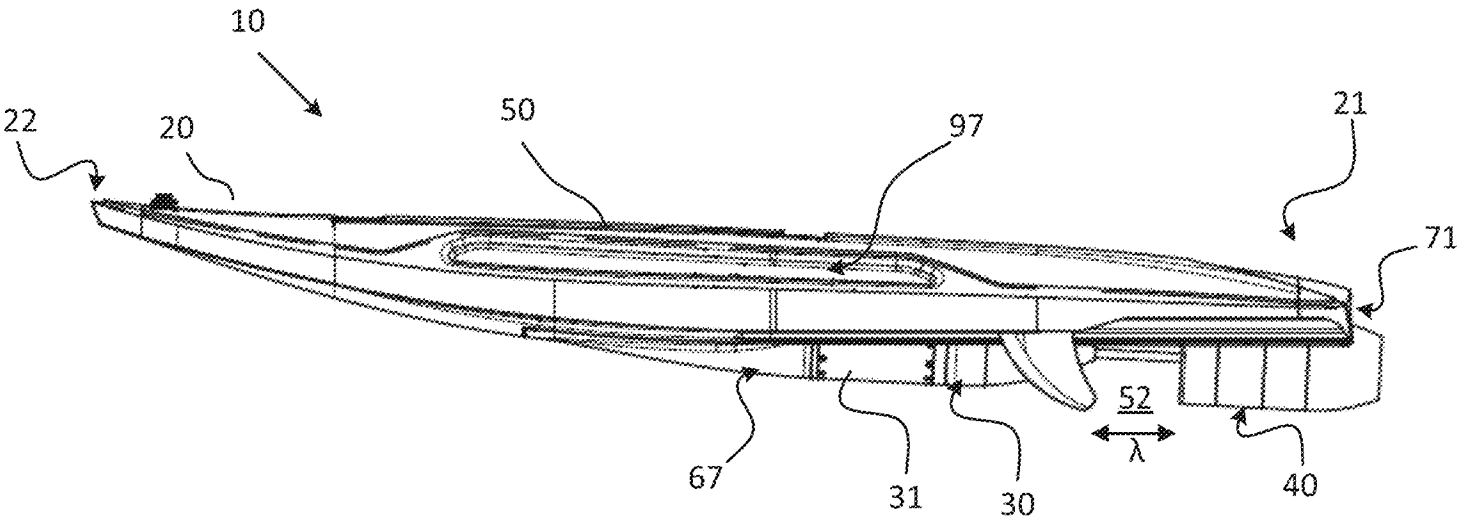
FIG. 7 shows an isometric side view of the watercraft according to an embodiment.

As most clearly depicted in FIGS. 5 and 7, the watercraft 10 may further comprise a flow guide 67. The wedge-shaped flow guide 67 is arranged on the bottom surface of the elongated hull 20 along the longitudinal central axis L. The flow guide 67 is arranged to guide water towards the first channel 93 and the second channel 94. Accordingly, the flow guide 67 is arranged between the first channel 93 and the second channel 94. Hence, the flow guide 67 may have a tip portion directed towards the front end 22 of the elongated hull 20. The flow guide 67 thus directs water towards the channels by means of splitting the water flow. This further increases the maneuverability of the watercraft since more water is directed to the channel of the downward tipping side of the elongated hull as the watercraft is turning.

In one embodiment, the flow guide 67 may have a conical shape, for example a partial conical shape. In one embodiment, the flow guide 67 is wedge-shaped.

In one embodiment which will be further described later on with reference to FIG. 10, the drive module is disposed in a recess or depression in the elongated hull, the flow guide 67 may be in the form of a casing for at least partially covering the drive module. In one embodiment, the flow guide 67 may be in the form of a motor casing for covering the motor 31 of the drive module.

In one embodiment, the drive module may be mounted to the elongated hull 20 by means of the flow guide 67. Thus, the flow guide 67 may be mounted to the elongated hull 20 by means of attachment elements, such as screws.

Figure 9A:
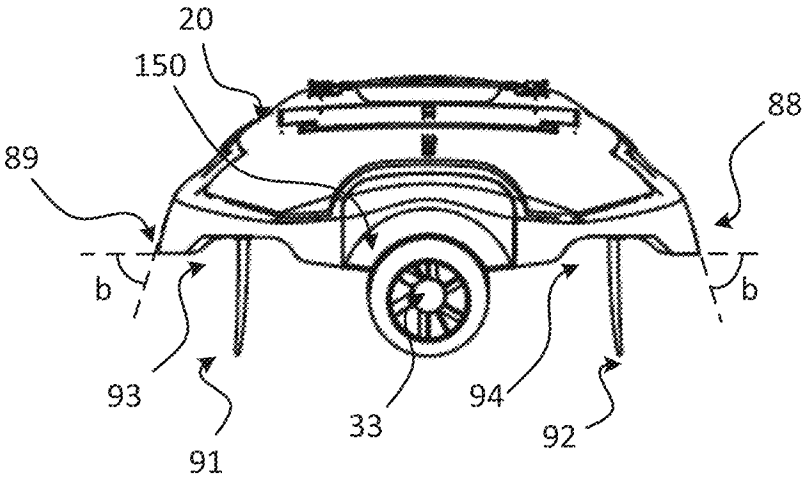
FIG. 9*a* shows an isometric back view of the watercraft according to an embodiment.
Figure 9B:
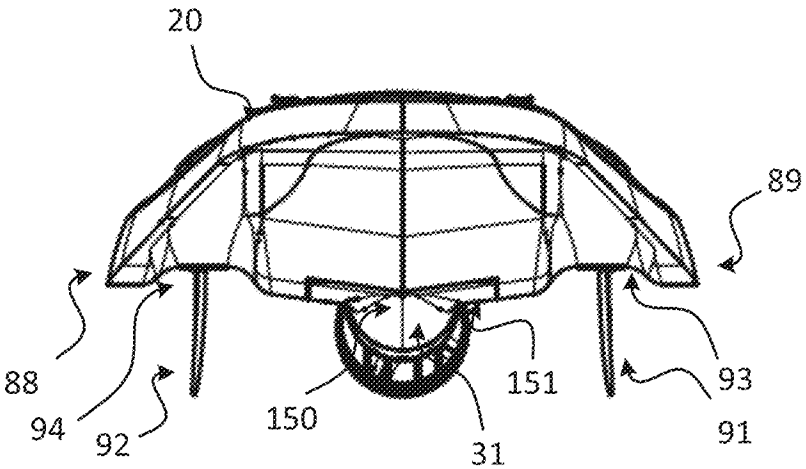
FIG. 9*b* shows an isometric front view of the watercraft according to an embodiment.

FIGS. 9*a-b* shows a front and back view of the watercraft 10, respectively. The first channel 93 and the second channel 94 each has a depth. The depth may equal to between 40 and 80% of the thickness of the elongated hull 20. Preferably the depth may equal between 60 and 80% of the thickness of the elongated hull 20. Accordingly, the elongated hull 20 may be substantially planar with a thickness which may be uniform or have a mean/average thickness.

As seen in FIG. 9*a*, the first protrusion 89 and the second protrusion 88 may each have an inclined outer longitudinal edge. The inclined longitudinal edges may each form a sharp bottom angle b. A sharp angle is herein referred to as an angle smaller than 90 degrees. Preferably b may be between 30 and 80 degrees. The sharp bottom angle is thus a sharp angle relative the bottom surface of the elongated hull and/or the bottom surface of the first and second lower protrusion, respectively.

Each of the lower protrusions may thus have an outwardly inclined outer longitudinal side, which extends diagonally and outwardly relative the longitudinal central axis L towards the bottom surface of the elongated hull and/or the bottom surface of the lower protrusion. Said outwardly inclined outer longitudinal side may face away from the longitudinal central axis L and the bottom surface of the lower protrusion.

Thus, the first lower protrusion 89 may have an outwardly inclined outer longitudinal side which extends diagonally and outwardly relative the longitudinal central axis L and towards the bottom surface of the first lower protrusion 89. Said outwardly inclined outer longitudinal side may face away from the longitudinal central axis L. The outwardly inclined outer longitudinal edge side may form at least a part of the first outer side carve 95.

The second lower protrusion 88 may have an outwardly inclined outer longitudinal side which extends diagonally and outwardly relative the longitudinal central axis L and towards the bottom surface of the second lower protrusion 88. Said outwardly inclined outer longitudinal side may face away from the longitudinal central axis L. The outwardly inclined outer longitudinal side may form at least form a part of the second outer side carve 96.

Worded differently, the inclined outer longitudinal edges of the protrusions may each extend in a sharp angle relative a plane formed by the bottom surface of the lower protrusion towards the top surface of the elongated hull 20.

The sharp bottom angle of the inclined outer longitudinal edge of the first lower protrusion and second lower protrusion may be considered the angle of the inclined outer longitudinal side of the first and second lower protrusion relative the bottom surface of the first and second lower protrusion, respectively. Said angle facing the longitudinal central axis L. In FIG. 9*a-b*, the angle is represented by the angle between a tangent of the inclined outer longitudinal side of the protrusion and the bottom surface of the lower protrusion.

The first and second outer side carves 95, 96 may extend at an angle between the top and bottom surface of the elongated hull to form the sharp bottom angle of the lower protrusions.

The sharp bottom angles reduce the area which is contact with the water during turning of the watercraft and does together with the channels allows for an increased grip in the water when maneuvering the watercraft, in particular when turning.

This first channel 93 and the second channel 94 may each form a longitudinal surface portion of the bottom surface of the elongated hull 20. The first channel 93 and the second channel 94 may also each form a pair of vertically extending surfaces. The vertically extending surfaces are interconnected by means of the longitudinal surface portion of the bottom surface of the elongated hull 20. The pair of vertically extending surfaces are inclined so as to form obtuse angles relative the longitudinal surface portion. The obtuse angle makes the channels easier to produce. Furthermore, the shell material of the elongated hull will become more durable since sharp transitions in the material which are susceptible to fracturing and cracks are avoided.

The first and second channels 93, 94 may thus be formed as slanted indentations on the bottom surface of the elongated hull 20. The longitudinal surface portions may be considered the bottom surface of the first and second channels 93, 94, respectively.

The vertically extending walls may be considered channel walls extending along the channels 93, 94. The pairs of vertically extending walls forms the first and second channels 93, 94 together with the longitudinal surface portions. The pairs of vertically extending surfaces thus forms the width of the first and second channels, respectively.

The longitudinal surface portions of each of the first and second channels 93, 94 may extend substantially horizontally relative each pair of said vertically extending surfaces. The obtuse angles thus refer to the angles between the vertically extending surfaces and the longitudinal surface portions of each of the first channel 93 and the second channel 94.

The vertically extending surfaces may extend in an obtuse angle relative a plane formed by each of the longitudinal surface portions. Said obtuse angles may each extend outwardly from a center axis of each of the longitudinal surface portions, e.g. of each of the first channel 93 and second channel 94. The center axis of each of the longitudinal surface portions may extend in the plane of each longitudinal surface portion. The vertically extending surfaces of each channel 93, 94 may slant inwards in a direction which extends partially towards said center axis of the longitudinal surface portion of the channel.

Worded differently, a first vertically extending surface of the pair of vertically extending surfaces formed by the first channel 93 and a second vertically extending surface formed by the first channel 93 may be arranged at a distance from each other and extend diagonally away from each other as seen from the longitudinal surface portion of the first channel 93.

Correspondingly, a first vertically extending surface of the pair of vertically extending surfaces formed by the second channel 94 and a second vertically extending surface formed by the second channel 94 may be arranged at a distance from each other and extend diagonally away from each other as seen from the longitudinal surface portion of the second channel 94.

Obtuse angle is herein referred to as an angle greater than 90 degrees, preferably between 100 and 135 degrees.

Figure 8:
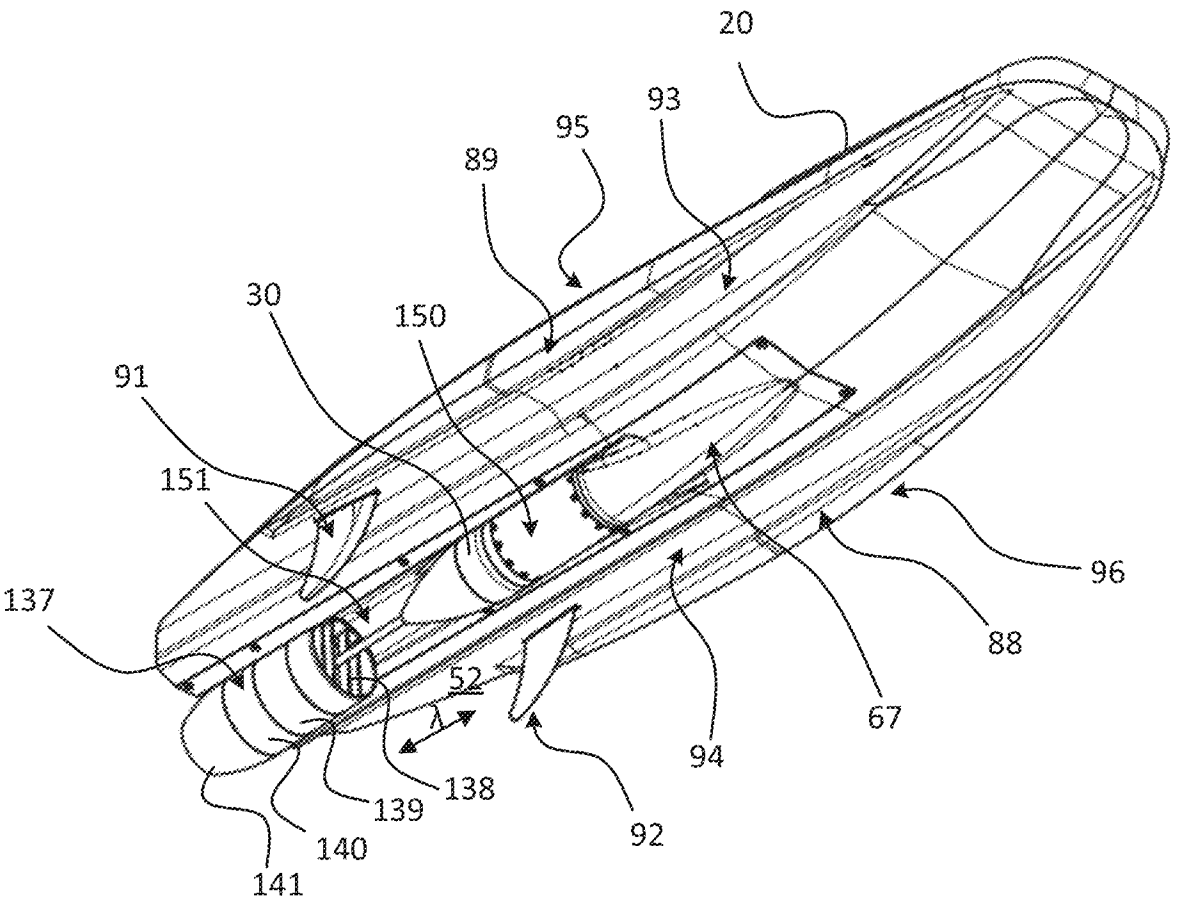
FIG. 8 shows a perspective view of the watercraft according to an embodiment.
Figure 10:
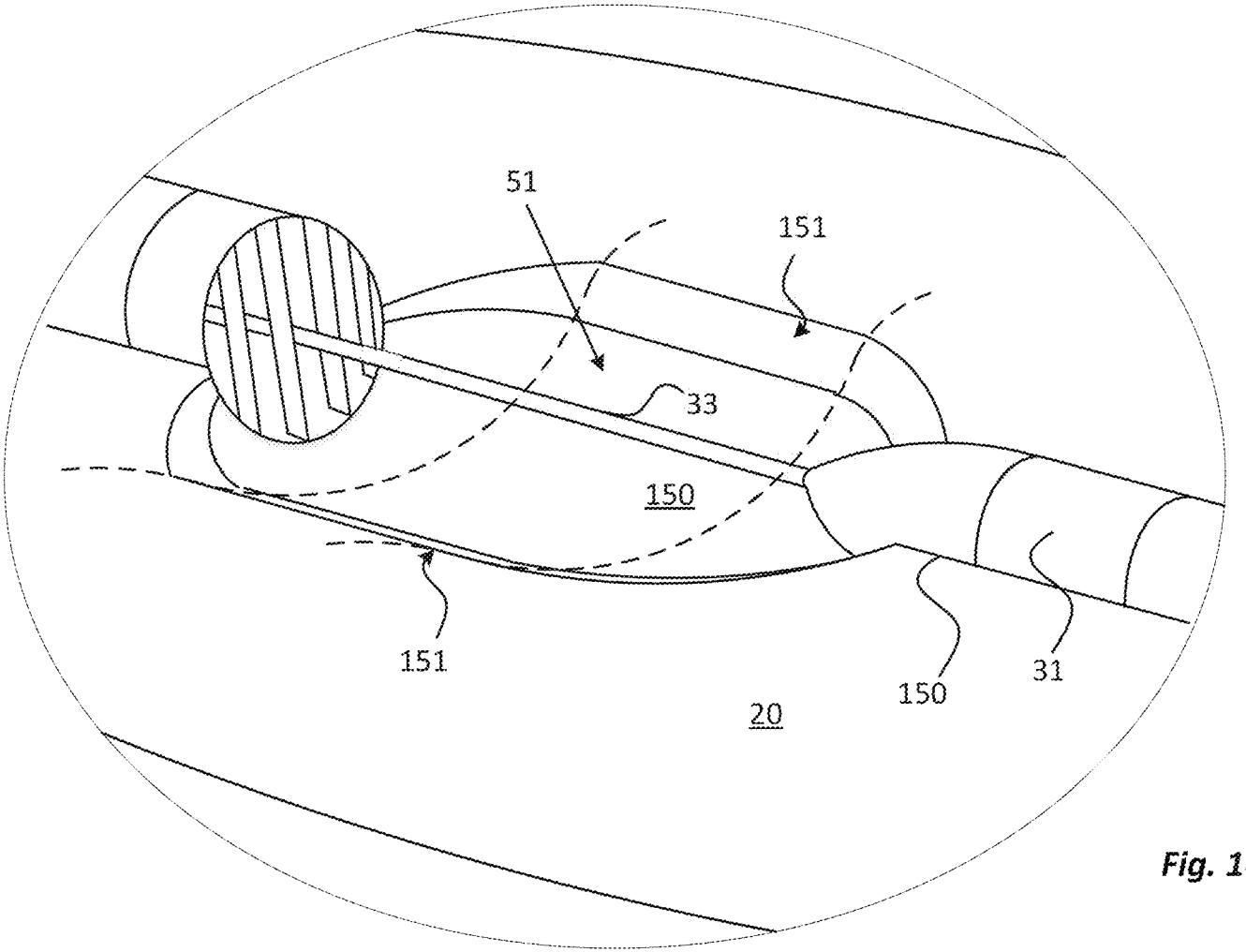
FIG. 10 shows details of the elongated hull and the drive module according an embodiment.

Referring to FIGS. 8 to 10 and in particular FIG. 10, a bottom surface of the hull module 20 may comprise an oblong depression 150 extending in the longitudinal direction of the hull module 20 and configured to receive at least a portion of the drive module 30. The depression 150 is preferably elongated. The longitudinal axis of the depression 150 is substantially parallel the longitudinal axis of said drive module 20, i.e. the longitudinal central axis L. In one embodiment, the depression 150 extends along the longitudinal central axis L.

The depression 150 may have a length corresponding to the drive module 20. The depression 150 brings about the advantageous effect that the hydrodynamic resistance of the watercraft is greatly improved. Also, by arranging the drive module 20 partially submerged into the hull module 20, i.e. in the depression 150, the maneuverability of the watercraft is improved.

This is particularly advantageous in conjunction with the first and second channel extending along the elongated hull, since the water flow is optimized along the entire width of the elongated hull and the submerged drive module does not create any disturbances in the water flow as the watercraft is turning, i.e. when one of the channels is in the air and the other is submerged in water.

Referring to FIG. 10, said depression 150 has a cross sectional shape corresponding to a semi-circle or semi-cylindrical shape which envelopes substantially half of a corresponding cylindrical shape of the drive module 30, in particular the motor 31 (or a motor casing) and the cylindrical casing of the propelling member 32, 139, i.e. the pod 40.

Figure 11A:
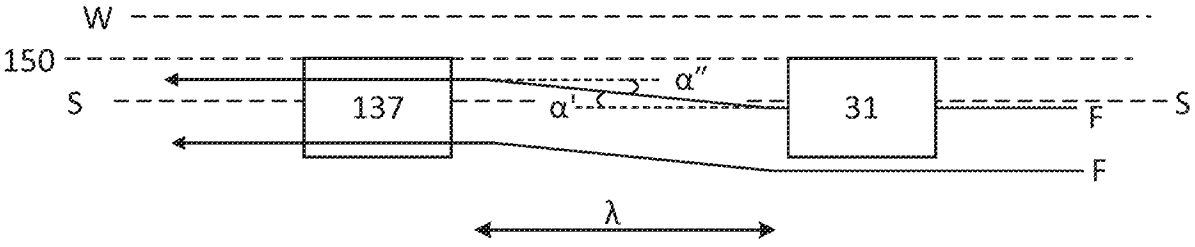
FIG. 11*a* is a schematic illustration of a fluid flow.
Figure 11B:
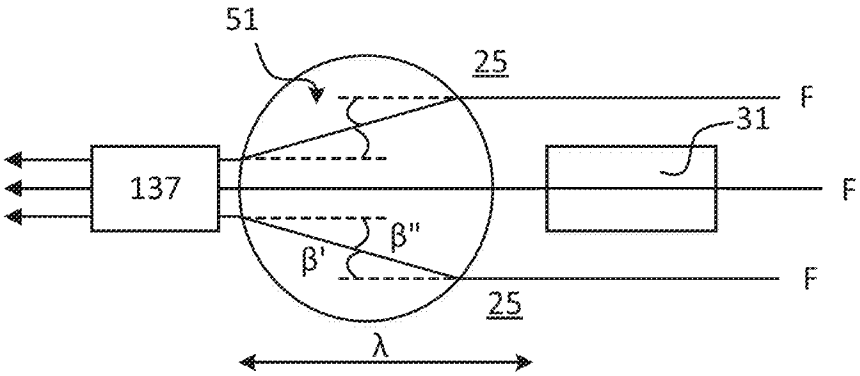
FIG. 11*b* is another schematic illustration of a fluid flow.
Figure 12:
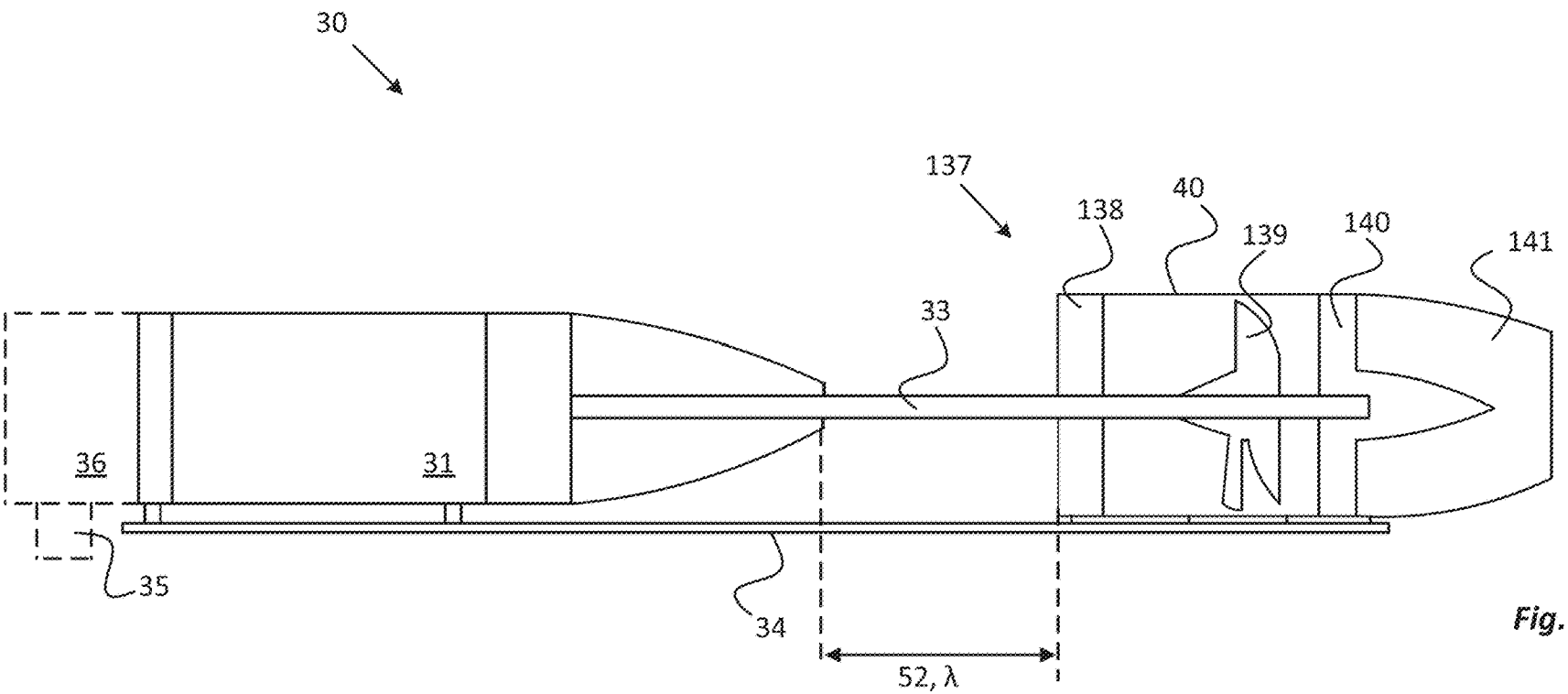
FIG. 12 shows a schematic illustration of a water-jet arrangement according to an embodiment.

The surface of the elongated hull 20 adjacent a portion of the depression 150 in the immediate vicinity of the gap 52 between the motor 31 and the pod 40 may comprise evened out edges to form a smooth gradual transition 151 between the surface of the hull module 20 and the depression 150. Hence, the width of the depression 150 is substantially wider in the vicinity of the gap 52, as shown in FIGS. 11*b* and 12. The gradual transition 151 between the surface of the hull module 20 and the depression 150 forms a cavity 51 extending around the gap 52, i.e. extends over the vicinity of the drive shaft 33. Thereby the shaft 33 extend through a void which faces the open water during operation, this facilitates increased water-ingestion of the water jet arrangement 137.

Thanks to the gap 52 being configured to cooperate with the cavity 51 by adapting the length λ thereof, the drive module 30 facilitates improved maneuverability of the watercraft 10 while maintaining a high efficiency of the water jet arrangement and low hydrodynamic losses. FIG. 11*a* is a schematic side-view of how the configuration of the gap 52 achieves that the angles of deflection/diversion α', α" of a fluid flow F to be ingested is minimized along the drive module 30. Also shown in FIG. 11*a* is the waterline W of the watercraft 10, the depression 150 and the bottom surface S of the hull module 20. As derivable, the fluid flow F, i.e. water to be ingested is provided a sufficient distance to flow into the cavity 51 by means of a small angle of diversion α' relative to the bottom surface of the hull module 20 and subsequently provided sufficient distance to attain a flow direction parallel the drive shaft 33 (not shown in FIG. 11*a*) by means of a small angle of diversion α". Thus, the angles of deflection α' and α" are minimized by providing the gap 52 with the length λ between the impeller 139 and the motor 31, while still the motor 31 and the water-jet arrangement 137 are both submerged and coaxially arranged in the hull module 20. This principle also applies for water flowing into the open cavity 51 from the vicinity of the cavity 51, for example from the flanks 25 on each side of the open cavity 51 as shown in FIG. 11*b*; the gap 52 with the length λ and the gradual transition 151 facilitates hydrodynamically advantageous flow path which minimizes the angles of diversion β' and β" and thus energy losses of water flowing into the cavity 51 from the vicinity of the cavity 51, for example from the flanks 25 on each side of the cavity 51.

Referencing FIG. 12, the water jet arrangement 137 of the drive module 30 comprises a casing or pod surrounding the propelling member 32. The casing 40 and the motor unit 31 are not in direct contact with each other. The motor 31 and the propelling member 32 are separated by a gap 52 having the length λ. λ may be in the range of 10 to 30% of the length of the drive module 20, preferably between 10 to 20%.

The depression 150 may extend along approximately between 20 to 40% of the length of the hull module 20, preferably about 33%.

The casing or pod 40 and the motor 31 are respectively attached to a hull connection 34 which fixates the positions of the pod 40 and the motor 31.

The propelling member 32 may be an impeller 139 disposed in the pod 40. The pod 40 comprises a stator 140 downstream the impeller 32. The pod 40 also comprises a nozzle portion 141 downstream of the stator 140. Optionally, the pod 40 also comprises inlet guide vanes 138 configured to protect the impeller 139 and to facilitate that a flow of water into the pod 40 is directed in the direction of the longitudinal extension of the pod 40. The stator 140 facilitates reduced turbulence aft/downstream of the impeller 139 and thus increases the efficiency of the drive module 30. Further, the stator also facilitates that the water jet created by the water jet arrangement 137 is straightened, i.e. directed in a longitudinal direction of the water jet arrangement 137. The nozzle portion 141 of the pod 40 comprises a section with decreasing inner diameter of the pod 40, and thus facilitates an increase in the velocity of the exiting water jet at an exit of the nozzle portion 141. The pod 40, the stator 140 and optionally the inlet guide vanes 138 are made or provided as one entity or as an assembly. The diameter of the pod 40 is preferably greater than the diameter of the motor casing.

The gap 52 is also advantageous in terms of directing water towards the channels. Hence, the water guided by means of flowing through the gap is deflected outwards towards the channels. During turning this will help facilitate the turning motion due to the water flow moving towards the channel which is tilted downwards into the water.

Accordingly, the motor 31 may be disposed with a distance apart along the longitudinal central axis L from the propelling member 32, 139 to form the gap 52 such that the drive shaft 33 drivingly connecting the propelling member and the motor extends through a void space.

The gap may have an axial length λ configured to cooperate with the cavity 51 of the elongated hull 20.

The connector means 35 of said drive module 30 may be received in the power module 50, as derivable from FIGS. 1 and 6.

The propulsion system 60, also referred to as the propulsion system, comprises the power module 50 and the drive module 30. The drive module 30 is configured to be mounted to a bottom surface of an elongated hull 20 of said watercraft. The propulsion system 60 is independently waterproof and capable of operating independently the elongated hull 20. Hence, the power module 50 and drive module 30 work together externally the elongated hull 20.

In a preferred embodiment, the propulsion system comprises the electronic speed controller (ESC) 36 arranged surrounded by water to provide the ESC 36 with passive cooling from the surrounding water in which it is submerged during operation.

It should be appreciated that embodiments of the disclosure are generally combinable unless specified.

The invention claimed is:

1. A motorized watercraft comprising:

an elongated hull extending along a longitudinal central axis (L); and a propulsion system, the propulsion system including a drive module mounted to the elongated hull;

wherein the drive module includes a motor and a propelling member, the motor being in driving connection with the propelling member;

wherein a bottom surface of the elongated hull is provided with a first channel and a second channel that respectively extend along the elongated hull on each side of the longitudinal central axis (L);

wherein the elongated hull includes an elongated recess or depression extending in a longitudinal direction of the elongated hull and configured to receive the drive module;

wherein the first and the second channels are laterally spaced apart from and extend longitudinally along a portion of the elongated recess or depression; and wherein the watercraft is a hydrofoiling watercraft, a motorized surfboard, a motorized wakeboard, a jet ski/water scooter, a motorized standup paddle board, or an over water drone.

2. The watercraft according to claim 1, wherein the drive module is arranged at the bottom surface of the elongated hull.

3. The watercraft according to claim 1, wherein the propelling member and/or the drive module is arranged along the longitudinal central axis (L).

4. The watercraft according to claim 1, wherein the first and the second channels are parallel to the longitudinal central axis (L).

5. The watercraft according to claim 1, wherein the elongated hull has a first outer side carve and a second outer side carve extending longitudinally.

6. The watercraft according to claim 5, wherein the first channel extends proximal to the first outer side carve; and wherein the second channel extends proximal to the second outer side carve.

7. The watercraft according to claim 6, wherein the first channel and the first outer side carve form a first lower protrusion extending along the first outer side carve; and wherein the second channel and the second outer side carve form a second lower protrusion extending along the second outer side carve.

8. The watercraft according to claim 7, wherein each of the first and the second lower protrusions has an inclined outer longitudinal edge forming a sharp bottom angle (b) relative the bottom surface of the elongated hull.

9. The watercraft according to claim 5, wherein an upper side of the elongated hull is provided with a first recess extending along the first outer side carve and a second recess extending along the second outer side carve.

10. The watercraft according to claim 1, wherein a first fin is arranged inside the first channel; and wherein a second fin is arranged inside the second channel.

11. The watercraft according to claim 10, wherein the first and the second fins are arranged in an outward angle (a) relative the longitudinal central axis (L).

12. The watercraft according claim 11, wherein the outward angle (a) is between 0.5 and 15 degrees.

13. The watercraft according to claim 1, wherein each of the first and the second channels has a depth equal to between 40% and 80% of a thickness of the elongated hull.

14. The watercraft according to claim 1, wherein each of the first and the second channels forms a longitudinal surface portion of the bottom surface of the elongated hull and a pair of vertically extending surfaces interconnected by the longitudinal surface portion, the pair of vertically extending surfaces being inclined so as to form obtuse angles relative the longitudinal surface portion.

15. The watercraft according to claim 1, wherein the propulsion system comprises an electric power module for powering the drive module.

16. The watercraft according to claim 1, further comprising a flow guide arranged on the bottom surface of the elongated hull along the longitudinal central axis (L), the flow guide being arranged to guide water towards the first and the second channels.

* * * * *